US006264035B1

(12) United States Patent
Petrie

(10) Patent No.: US 6,264,035 B1
(45) Date of Patent: Jul. 24, 2001

(54) DISPENSER FOR MERCHANDISE BAGS

(75) Inventor: Richard S. Petrie, Pickerington, OH (US)

(73) Assignee: Orange Plastics, Inc., Compton, CA (US)

( * ) Notice: Subject to any disclaimer, the term of this patent is extended or adjusted under 35 U.S.C. 154(b) by 0 days.

(21) Appl. No.: 09/207,013

(22) Filed: Dec. 7, 1998

Related U.S. Application Data

(63) Continuation-in-part of application No. 08/785,859, filed on Jan. 20, 1997, now Pat. No. 5,924,573.

(51) Int. Cl.[7] ..... B65D 33/00

(52) U.S. Cl. ..... 206/554; 248/100; 383/209

(58) Field of Search ..... 206/554; 248/95, 248/99, 100; 383/9, 10, 37, 207, 209; 211/50, 59.1

(56) References Cited

U.S. PATENT DOCUMENTS

| | | | | |
|---|---|---|---|---|
| Re. 33,264 | | 7/1990 | Baxley et al. . | |
| 1,711,070 | | 4/1929 | Suydam, Jr. . | |
| 4,106,734 | | 8/1978 | Walitalo . | |
| 4,480,750 | | 11/1984 | Dancer . | |
| 4,744,200 | | 5/1988 | Benoit, Jr. et al. . | |
| 4,769,126 | * | 9/1988 | Roen et al. | 206/554 |
| 4,785,938 | | 11/1988 | Benoit, Jr. et al. . | |
| 4,796,759 | | 1/1989 | Schisler . | |
| 4,811,417 | | 3/1989 | Prince et al. . | |
| 4,854,451 | * | 8/1989 | Jensen | 206/554 |
| 4,877,473 | | 10/1989 | Snowdon et al. . | |
| 4,989,732 | | 2/1991 | Smith . | |
| 5,074,674 | | 12/1991 | Kuklies et al. . | |
| 5,092,548 | * | 3/1992 | Bayes et al. | 248/99 |
| 5,183,158 | | 2/1993 | Boyd et al. . | |
| 5,269,416 | | 12/1993 | DeMatteis . | |
| 5,323,909 | | 6/1994 | Piraneo et al. . | |
| 5,419,437 | * | 5/1995 | Huseman | 206/554 |
| 5,458,301 | | 10/1995 | Cournoyer . | |
| 5,590,784 | | 1/1997 | Daniels . | |
| 5,626,550 | | 5/1997 | Amero et al. . | |
| 5,667,173 | * | 9/1997 | Wilfong, Jr. et al. | 248/100 |
| 5,924,573 | * | 7/1999 | Piraneo et al. | 206/554 |
| 5,979,841 | * | 11/1999 | Piraneo et al. | 206/554 |

FOREIGN PATENT DOCUMENTS 0596747 5/1993 (EP) .

OTHER PUBLICATIONS

Novapol™, Polyethylene Product Data Sheet Film Resin, Novacor.

Alathon® Lathon® L5005 High Density Polyethylene Resin Film, Oxychem.

Merchandise Bag Sold by Orange Plastics, Inc.

* cited by examiner

*Primary Examiner*—Luan K. Bui
(74) *Attorney, Agent, or Firm*—Denton L. Anderson; Sheldon & Mak

(57) ABSTRACT

A bag dispenser for supporting and dispensing merchandise bags from bag packs comprises an intermediate portion and two end portions. Intermediate and end bag engaging members extend outwardly from the intermediate and end portions, respectively, and are sized for insertion through an aperture of the bag pack. The dispenser also includes a bag support member disposed below the bag engaging members for supporting the bag through a handle hole, so that the bag is supported during loading and does not tear from the header of the bag pack.

12 Claims, 3 Drawing Sheets

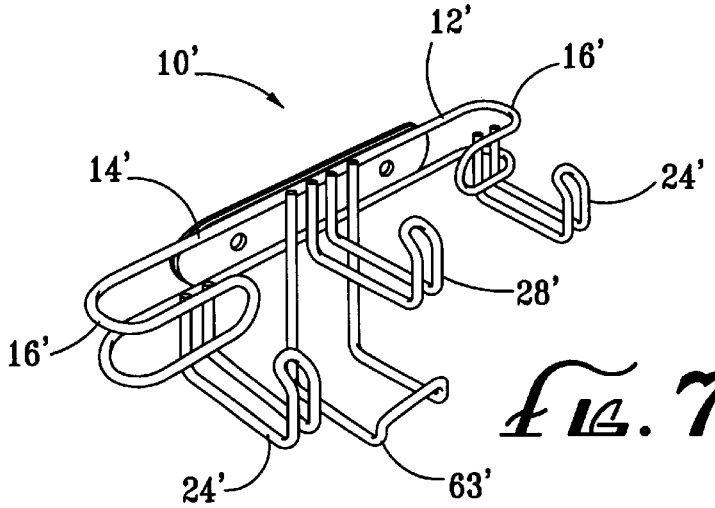
FIG. 7
FIG. 8
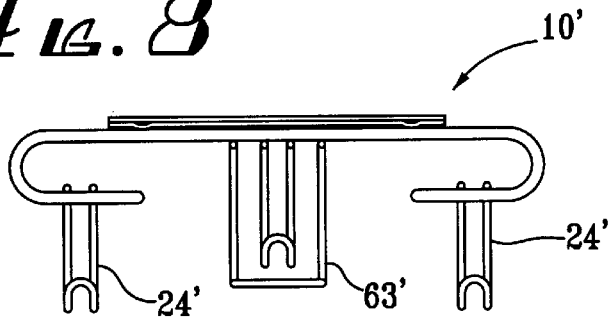
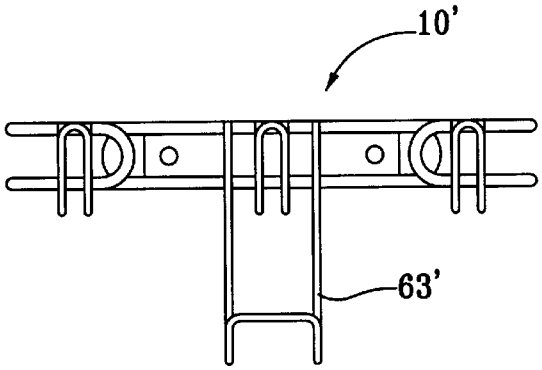
FIG. 9
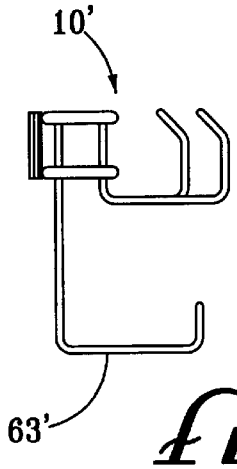
FIG. 10

DISPENSER FOR MERCHANDISE BAGS

RELATED APPLICATIONS

This application is a continuation-in-part of U.S. patent application Ser. No. 08/785,859, filed Jan. 20, 1997, U.S. Pat. No. 5,924,573 which is incorporated herein by reference.

BACKGROUND

The invention is directed to bag dispensers, and, more particularly, to bag dispensers for plastic bags.

In many shopping environments—e.g. grocery stores, mall specialty shops, department stores—customer purchases are often loaded into plastic bags provided in stacked bundles known as bag packs. The bundles consist of individual bags stacked into a pack and secured together using small welds or adhesives. The bags are typically either merchandise bags or tee shirt style bags.

To expedite and simplify the bagging operation, the bag packs are commonly suspended on a metal support rack. Merchandise bags are secured together in a header that is typically connected to the remainder of the bag pack across a perforated portion that is cut in each bag panel. To remove the bag from the header, the perforated portion is torn or severed by pulling on the bag.

Stores are always attempting to reduce costs and eliminate inefficiencies, including those of their checkout and bagging operations. One of the more recent innovations is the scan-and-bag, also known as scan-and-load, method of handling merchandise at the checkout counter. In this method, a universal price code (UPC) associated with the merchandise is scanned, and then the merchandise is immediately placed in a bag supported below the checkout counter. This technique results in the use of fewer personnel at checkout counters, or at least more efficient checkout procedures by a single individual. For example, at one cash register station in a department store, or a checkout in a small specialty shop, the sales person can remove the merchandise from the counter as it is scanned and place it in the bag. This method eliminates scanning the products, stacking them in a separate place, and then subsequently bagging them when the sales transaction is complete.

Besides inefficiency, another problem associated with older bagging techniques is pilferage. Customers remove small sale and novelty items displayed near the cash register or checkout counter, and then they stack them with the scanned merchandise sitting on the counter while the salesperson's back is turned to obtain a credit card authorization. Skilled shoppers and shoplifters place such items in the group of materials already totaled, so that the sale or novelty items, for which no payment has been made, are bagged with items that have been paid for. The scan-and-bag method eliminates this problem.

One difficulty of the scan-and-bag technique is the support of the bag below the counter while it is being loaded, so that the bag does not tear from the header of the bag pack. One solution to this problem has been the counter cutout, in which the sales counter is notched and a surface placed at approximately the level of the bag bottom to support the bag and its contents. An example of a cutout is depicted in FIG. 6, where a bag support rack as disclosed in the aforementioned application Ser. No. 08/785,859 is shown. Cutouts, however, are costly; they can shut down a cash register during construction; and, they cannot always be retrofitted into an existing counter configuration. Therefore, it is desirable to develop a bagging system that can be used in a scan-and-bag operation without the problems and limitations of existing technology.

SUMMARY

The present invention provides a bagging system that meets the need for a scan-and-bag operation without the cost of creating cutouts, whether in existing counters or counters under fabrication. It is also more efficient and solves the problem of pilferage of the sales items around the cash register.

The bagging system utilizes a novel bag dispenser that includes a rack having an intermediate portion having two end portions, with an outer bag engaging element (or member) extending outwardly from each end portion, and an intermediate bag engaging element (or member) extending from the intermediate portion. Additionally, a bag support element (or member) is disposed below the level of the bag engaging elements to support a merchandise bag during bagging. Preferably, the intermediate bag engaging element is shorter than the outer bag engaging element to cause an arc in the bags. Stated another way, preferably the bag engaging elements lie substantially on an arc having a center located forward of the ends of the bag engaging elements to urge a bag open during the loading and dispensing of that bag. The bag engaging elements pass through holes in the header of the bag pack, and the bag support member passes through a support aperture, typically the bag handle opening. The dispenser also includes means for attaching the dispenser to a support surface, such as a screw plate.

DRAWINGS

These and other features, aspects, and advantages of the present invention will become better understood from the following description, appended claims, and accompanying drawings, where:

FIG. 7 is a perspective view of another version of a bag dispenser according to the present invention;

FIG. 8 is a top plan view of the dispenser of FIG. 7;

FIG. 9 is a front elevation view of the dispenser of FIG. 7; and

FIG. 10 is a side elevation view of the dispenser of FIG. 7.

DESCRIPTION

Figure 1:
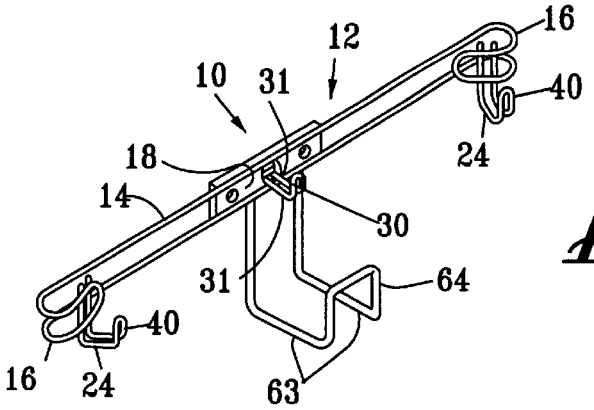
FIG. 1 is a perspective view of a bag dispenser according to the present invention.

With reference to FIGS. 1–3 and 5, a bag dispenser 10 according to the present invention includes an elongated rack 12 having a substantially planar, intermediate portion 14 and end portions 16. A flat mounting plate 18 is disposed at the intermediate portion 14 of the rack 12. The mounting plate 18 possesses two or more mounting holes 20. A fastener 22 is inserted through each hole 20 to attach the rack 12 to a vertically oriented support surface.

Optionally, the mounting plate 18 can be replaced by an L-shaped bracket (not shown), where one leg of the bracket is secured to the rack 12 and the other leg is attached to the bottom of a counter so that the dispenser 10 can be mounted underneath a counter.

An end bag engaging member, also referred to herein as an outer bag engaging element 24, is provided at each of the end portions 16. Each bag engaging element 24 comprises a hook 26 having a shaft 27. An intermediate bag engaging member 28, also referred to as a central bag engaging element, comprising a central hook 30 having a shaft 31, is provided on the intermediate portion 14 of the rack 12. The shafts 27, 31 of the hooks 26, 30, respectively, typically have a length of from about 1 to about 6 inches or more. Bag dispensers can be provided with different spacings between the hooks 26 and 30 to support different sized merchandise bags.

The bag dispenser 10 is used to support a pack 32 of merchandise bags 34, each bag having a front panel 36 and a rear panel 38.

Figure 2:
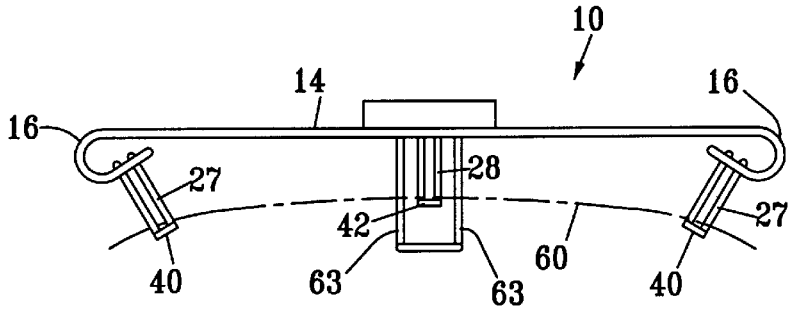
FIG. 2 is a top plan view of the bag dispenser of FIG. 1.

FIG. 2 illustrates the arrangement of the ends 40, 42 of the hooks 26, 30 of the bag dispenser 10. The ends 40, 42 lie substantially on a common arc 60. The arc 60 lies in a generally horizontal plane and has a center (not shown) located forward of the ends 40, 42. Thus, the end 40 of each outer hook 26 extends forwardly more than the end 42 of the central hook 30. This arrangement of the hooks 26, 30 urges suspended merchandise bags open during removal of the preceding bag from the bag dispenser 10. This enables merchandise bags 34 to be more easily loaded by individuals without having to struggle to separate the front panel 36 from the rear panel 38.

Figure 3:
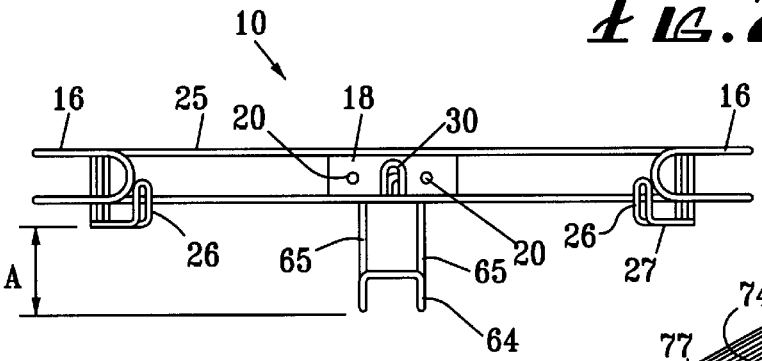
FIG. 3 is a front elevation view of the bag dispenser of FIG. 1.

FIGS. 1 and 3 depict a bag support member 63. In the preferred embodiment, the bag support member 63 uses a hook construction similar to hooks 26, 30, having a hook 64 with a shaft 65. The bag support member 63 is located directly below central hook 30, and extends forwardly more than the central hook.

Figure 4:
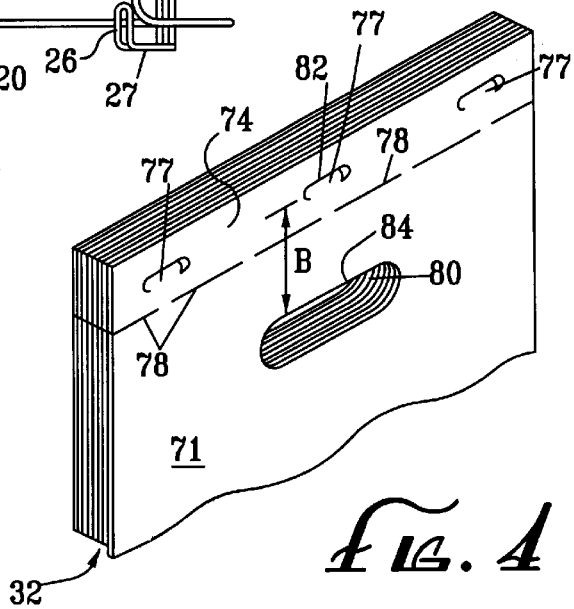
FIG. 4 is a perspective view of the merchandise bag pack for use with the bag dispenser of FIG. 1.

FIG. 4 depicts a merchandise bag pack 32 comprised of a plurality of single merchandise bags 34. Merchandise bag pack 32 is disclosed in the parent application Ser. No. 08/785,859. The bag pack 32 is formed by cold welding or gluing single bags 34. This attachment occurs in a header portion 74 of the bag pack 32. The bag pack includes three apertures 77 in the header 74 that enable the pack to hang from engaging members 26, 28. The front panel 36 and the rear panel 38, both of which are attached to the header 74, can be removed from the header 74 by tearing perforations 78 at the bottom of the header 74. Each bag 61 includes a handle opening 80 that passes completely through front and rear panels 36, 38. Thus, a customer can curl his or her fingers through the handle opening 80 to hold the bag 34. Consequently, the bag area above the handle opening 80 becomes a bag handle.

When in use, the bag dispensing system operates as follows. The bag dispenser 10 is mounted against a surface. Hooks 26, 30 pass through the apertures 77 in the header 74, supporting the bag pack 32. The bag support member 63 passes through handle opening 80, also supporting the complete bag pack.

Figure 5:
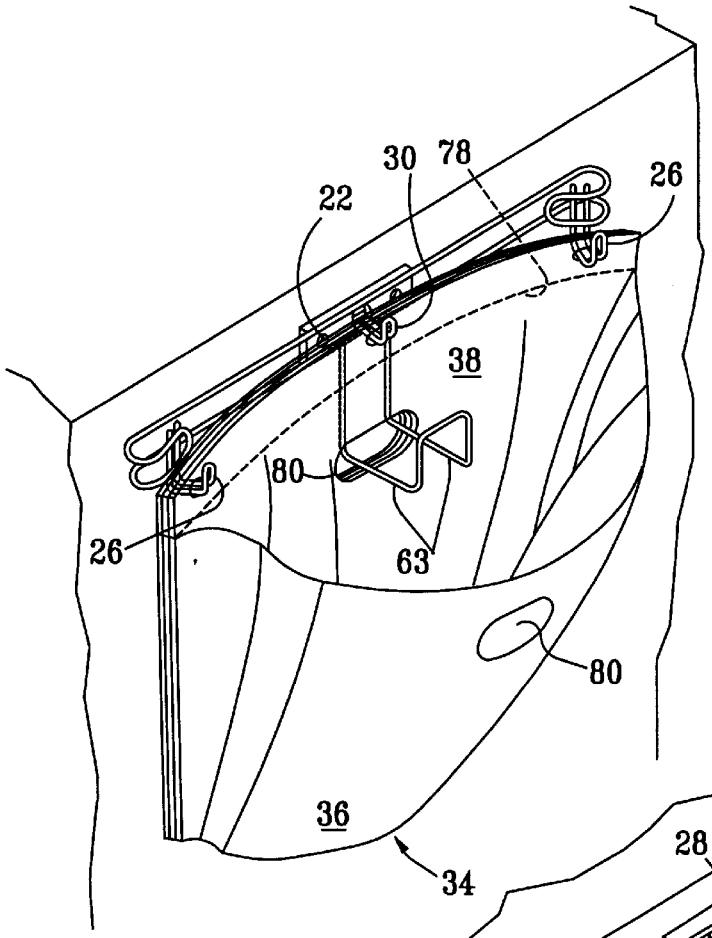
FIG. 5 is a perspective view of the merchandise bag pack of FIG. 4 open for filling with merchandise and also supported by the bag engaging members and the bag support member of the dispenser of FIG. 1.
Figure 6:
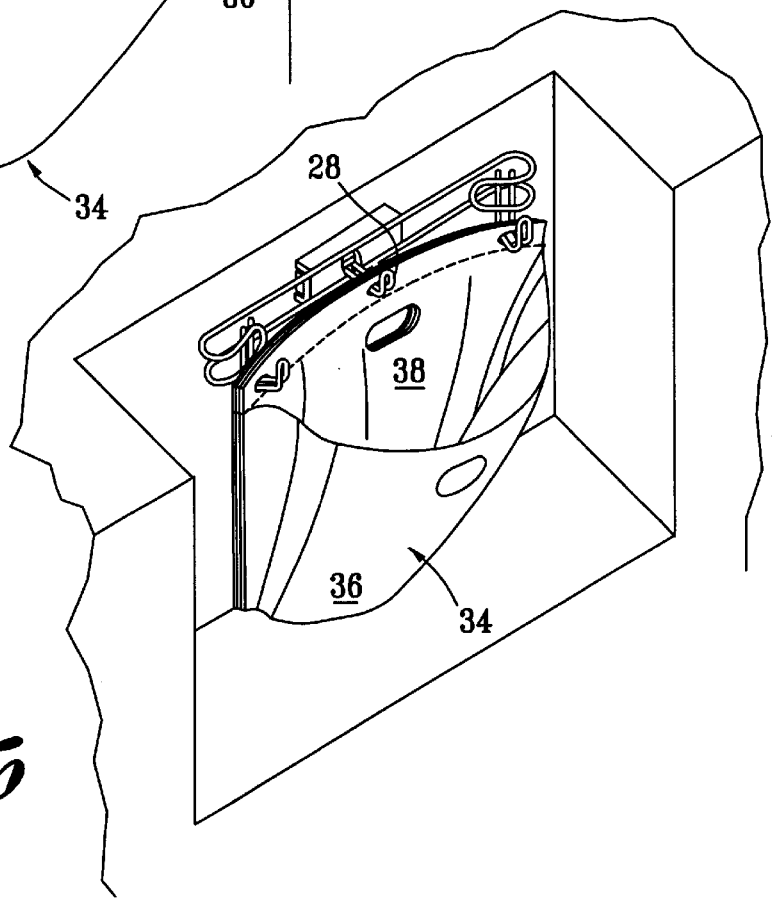
FIG. 6 is a drawing of a counter with a cutout portion to support the bottom of a bag during a scan-and-bag operation.

After a bag has been removed, the system appears as depicted in FIG. 5, with the bag 34 open because the perforations 78 of the front panel 36 have been torn and the front panel 36 pulled away from the header 74. The bag 34 in FIG. 5 is therefore supported by the three hooks 26, 30 and the bag support member 63. Without the support member 63, filling merchandise bag 34 in FIG. 5 would result in the weight of the bag 34 contents tearing the perforations 78 so that the bag 34 would fall. The hook 64 passing through handle opening 80 of the rear panel 38 prevents such an occurrence.

To ensure that the weight of the merchandise bag 34 and its contents is borne by the hook 64 and not by the bag 34 along the perforations 78, it is desirable that the vertical distance between the holes 77 and 80 is just slightly greater than the distance between the hooks 26, 30 and hook 64. This difference is depicted in FIGS. 3 and 4. In FIG. 3, the top 82 of the apertures 77 in the header 74 rest on the top surface of the shafts or wires 27, 31 of the hooks 26, 30. The top 84 of aperture 80 of the merchandise bag 34 rests on the top surface of shafts or wires 65 of the hook 64. In FIG. 3, the distance A represents the vertical distance between the top of wire 31 and the top of wire 65. In FIG. 4, B represents the distance between the top 82 of aperture 77 and the top 84 of handle aperture 80, which is typically 2 to 4 inches. It is desirable that the distance B be slightly less than A, the preferred difference being from about ⅛ to about ¼ inches, depending on bag size and bag thickness. With the system so configured, the weight of merchandise bag 34 and its contents is always principally borne by the top 84 of handle aperture 80, and not by the bag along perforations 78. Pushing bag 34 upward in such a manner also facilitates the opening of the next bag when the preceding adjacent bag is removed.

An alternate version of the present invention is shown in FIGS. 7–10, where a bag dispenser 10' comprises a rack 12' having an intermediate portion 14' and end portions 16'. Just as for the bag dispenser 10 of FIG. 1, there are provided two outer bag engaging elements 24', an intermediate bag engaging element 28', and a bag support member 63'.

The bag dispenser 10' of FIGS. 7–10 differs from the bag dispenser 10 of FIG. 1 in that the end portions 16' do not project rearwardly towards the intermediate portion 14 as does the end portions 16 of the bag dispenser 10. Instead, the end portions 16' only project centrally. This results in the bag engaging elements 24' projecting only outwardly, as best shown in FIG. 8, as compared to the outer bag engaging elements 24 of bag dispenser 10 projecting centrally, as shown in FIG. 2. The configuration shown in FIG. 7 of the bag dispenser 10' increases the capacity of the bag dispenser 10, avoiding binding of bags when a large number of bags are placed on the rack. Stated in another way, all the bag engaging elements 24' and 28' extend outwardly in a direction at a right angle to the plane of the intermediate portion 14', and all are parallel to each other.

A further result of this configuration is that the outer bag engaging elements 24' project outwardly about the same amount, or even more than does the bag support member 63', as shown in FIG. 8.

The present bagging system solves the costliness and inefficiencies associated with other scan-and-bag systems. The bag dispenser of the present invention can be mounted without modification to existing counters and can support an open bag with merchandise.

Although the present invention has been described in considerable detail with reference to certain preferred versions, other versions are possible. For example, wire, bar or round stock can be used to form the bag dispenser. Even plastics could be used. More than three hooks could be configured to hold up the bag pack at the header. The mounting plate could use three fasteners, or it could use adhesive instead. Aperture 80 is preferably used for the handle but need not be. Therefore, the spirit and scope of the appended claims should not be limited to the description of the preferred versions contained herein.

What is claimed is:

1. A bagging system comprising:

(i) a bag pack comprising a header, apertures through the header, and a plurality of merchandise bags, each merchandise bag being tearably attached to the header and having front and rear panels with a support aperture disposed below where the bag is tearably attached to the header; and (ii) a bag dispenser comprising:

1) an elongated rack having an intermediate portion with two end portions disposed at the ends of the intermediate portions;

2) a plurality of bag engaging elements projecting from the rack, each bag engaging element having an end comprising a horizontal extension which is inserted through the header aperture, wherein the bag engaging elements are separate elements from the end portions of the rack; and 3) a bag support member disposed below the bag engaging members and having an end comprising a horizontal extension that is of a length greater than the horizontal extension of any bag engaging member, the horizontal extension being inserted through the support aperture and being of a sufficient length to support an open bag during placement of merchandise in the bag;

wherein the bag pack is supported by the dispenser with the bag engaging elements engaging the header apertures and the bag support member engaging the support aperture.

2. The bagging system of claim 1 wherein the distance from the header apertures to the support aperture is slightly less than the distance from the bag engaging elements to the support member.

3. The bagging system of claim 1, wherein the distance from the header apertures to the support aperture is from about ⅛ to about ¼ inch less than the distance from the bag engaging members to the support member.

4. The bagging system of claim 1 wherein the support aperture is sufficiently large to serve as a handle.

5. The bagging system of claim 1 wherein there are three header apertures and three corresponding bag engaging elements.

6. The bagging system of claim 5 wherein the bag engaging elements comprise two outer bag engaging elements and an intermediate bag engaging element, with the intermediate bag engaging element being shorter than the end bag engaging elements to urge the bags open during dispensing from the bag dispenser.

7. A bag dispenser for supporting and dispensing a pack of merchandise bags, each bag having a front panel, a rear panel connected to the front panel, a plurality of laterally spaced apertures formed through the front panel and the rear panel, and a support aperture below the laterally spaced apertures and also formed through the front and rear apertures, the bag dispenser comprising:

a) a rack having an intermediate portion and end portions, wherein the end portions curve inwardly towards the center of the rack;

b) a plurality of bag engaging members extending outwardly from the rack, each bag engaging member having an end comprising a horizontal extension for insertion through one of the laterally spaced apertures, wherein the plurality of bag engaging members are separate members from the end portions of the rack, wherein the bag engaging members comprise an intermediate bag engaging member and two end bag engaging members and wherein the ends of the intermediate bag engaging member and the ends of the end bag engaging members each lie substantially on an arc having a center located forward of the ends of the bag engaging members to urge the merchandise bags open during dispensing from the bag dispenser; and c) a bag support member disposed vertically below the bag engaging members and having an end for insertion through the support aperture, the end comprising a horizontal extension that is of a sufficient length to support an open bag during placement of merchandise inside the bag, the length of the horizontal extension being greater than the length of the horizontal extension of any bag engaging member.

8. The bag dispenser of claim 7, wherein the intermediate bag engaging member is shorter than the end bag engaging members.

9. A bag dispenser for supporting and dispensing a pack of merchandise bags, the pack comprising a header, laterally spaced apertures through the header, and a plurality of merchandise bags, each bag being tearably attached to the header and each bag having a front panel, a rear panel connected to the front panel, and an additional aperture forming a bag handle, the bag dispenser comprising:

a) a substantially planar intermediate portion with two ends;

b) end portions at the ends of the intermediate portion;

c) an intermediate bag engaging member extending outwardly from the intermediate portion, the intermediate bag engaging member having an end for insertion through an aperture of the header;

d) an end bag engaging member extending outwardly from each of the end portions, the end bag engaging members each having an end for insertion through an aperture of the header;

e) a bag support member with a bottom portion disposed below the bag engaging members and having an end for insertion through the handle aperture of the merchandise bag pack for supporting an open bag during placement of merchandise inside the merchandise bag; and f) means for mounting the dispenser to a surface.

10. The bag dispenser of claim 9, wherein each bag engaging member has a bag support point such that the points are in a generally horizontal plane.

11. The bag dispenser of claim 10, wherein a first vertical distance from the horizontal plane to the bottom of the bag support member is slightly less than a second vertical distance between the header apertures and the handle aperture.

12. The bag dispenser of claim 11, wherein the difference between the first distance and the second distance is from about ⅛ to about ¼ inch.

* * * * *